US011059498B2

(12) United States Patent
Evans

(10) Patent No.: US 11,059,498 B2
(45) Date of Patent: Jul. 13, 2021

(54) TROLLEY

(71) Applicant: Castree Projects Limited, Chester (GB)

(72) Inventor: David Nicholas Evans, Chester (GB)

(73) Assignee: CASTREE PROJECTS LIMITED, Chester (GB)

( * ) Notice: Subject to any disclaimer, the term of this patent is extended or adjusted under 35 U.S.C. 154(b) by 519 days.

(21) Appl. No.: 16/003,472

(22) Filed: Jun. 8, 2018

(65) Prior Publication Data

US 2019/0375434 A1 Dec. 12, 2019

(51) Int. Cl.
*B61B 13/04* (2006.01)
*B61B 5/00* (2006.01)

(52) U.S. Cl.
CPC ..... *B61B 13/04* (2013.01); *B61B 5/00* (2013.01)

(58) Field of Classification Search
CPC ..... B61B 13/04; B61B 5/00; B61B 3/00
See application file for complete search history.

(56) References Cited

U.S. PATENT DOCUMENTS 3,880,087 A * 4/1975 Pamer ..... B66C 7/00 104/123
5,038,900 A * 8/1991 Durant ..... D01H 9/182 198/465.4
5,231,932 A * 8/1993 Enderlein ..... B65G 19/025 104/162
6,138,574 A * 10/2000 Zaguroli, Jr. ..... E01B 25/24 104/106
6,745,891 B2 * 6/2004 Walter ..... B61B 10/025 104/172.4
6,758,325 B2 * 7/2004 Greeley ..... B61B 3/00 198/465.4
2008/0229967 A1 * 9/2008 Lins ..... B61B 3/00 104/173.1
2010/0107919 A1 * 5/2010 Perakis ..... B61B 12/026 104/112
2013/0042784 A1 * 2/2013 Quattlebaum ..... E01B 25/18 104/123
2015/0217783 A1 * 8/2015 Horihan ..... A63G 21/22 104/113
2017/0036123 A1 * 2/2017 Liggett ..... B61B 3/00
2017/0120935 A1 * 5/2017 Reese ..... A63G 21/20
(Continued)

*Primary Examiner* — Jason C Smith
(74) *Attorney, Agent, or Firm* — Hoffman Warnick LLC

(57) ABSTRACT

A trolley 100 for a rail 10 is described. The trolley 100 comprises a frame 110, a set S of wheels 120, including a first wheel 120A and a second wheel 120B, rotatably coupled to the frame 110 and an attachment member 130, coupled to the frame 110, for suspension of a load W therefrom, in use. The first wheel 120A is rotatable in a first plane P1 about a first axis A1 and the second wheel 120B is rotatable in a second plane P2 about a second axis A2. The first plane P1 and the second plane P2 define a line L. The trolley 100 is arrangeable in a first configuration, wherein the attachment member 130 is arranged at a first angular displacement D1 about the line L. The trolley 100 is arrangeable in a second configuration, wherein the attachment member 130 is arranged at a second angular displacement D2 about the line L, wherein the first angular displacement D1 and the second angular displacement D2 are different. A rail assembly 1, including the trolley 100 and the rail 10, is also described.

15 Claims, 14 Drawing Sheets

(56) References Cited

U.S. PATENT DOCUMENTS

| | | | | |
|---|---|---|---|---|
| 2017/0341864 | A1* | 11/2017 | Stauber | B65G 9/002 |
| 2019/0256110 | A1* | 8/2019 | Suarez Ajo | B61B 1/02 |
| 2019/0375434 | A1* | 12/2019 | Evans | A63G 21/22 |
| 2020/0054952 | A1* | 2/2020 | Wagner | A63G 21/20 |
| 2020/0062284 | A1* | 2/2020 | Evans | B61B 3/00 |
| 2020/0255036 | A1* | 8/2020 | Evans | B61B 7/00 |

* cited by examiner

DETAIL B

Fig. 11A
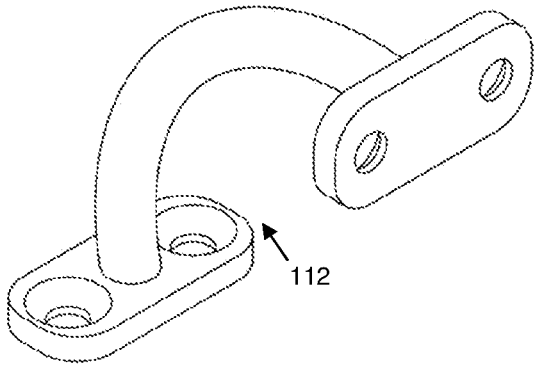
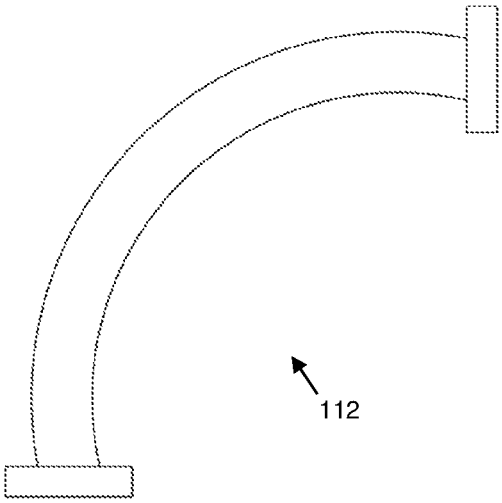
Fig. 11B
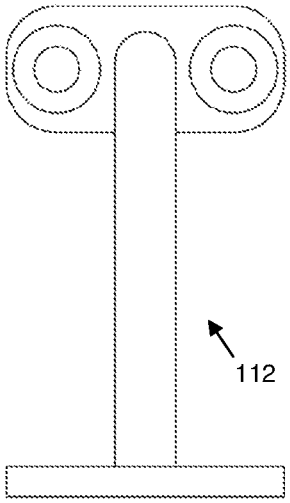
Fig. 11C

TROLLEY

FIELD

The present invention relates to trolleys for rails and to rail assemblies including rails and such trolleys.

BACKGROUND TO THE INVENTION

Typically, a zipline (also known as a zip-line, zip wire, aerial runway or aerial ropeslide) comprises an inclined cable, secured only at upper and lower ends thereof, and a trolley (also known as a bogey), including a freely-rolling pulley. A user (i.e. a load), suspended from the trolley, may be accelerated by gravity from the upper end to the lower end of the inclined cable. In use, the pulley rolls along an uppermost portion of the inclined cable. A gradient of the inclined cable is typically in a range from 1 in 20 to 1 in 30. Usually, the inclined cable sags and appropriate tensioning of the inclined cable is required to control acceleration of the user. Since the inclined cable is secured only at the upper and the lower ends thereof, the inclined cable is restricted to a linear path, without lateral deviations, such as curves or bends.

To provide a non-linear path including lateral deviations, such as curves or bends, the cable may be replaced with a rail, typically a monorail. The non-linear path enables the rail to curve around obstacles, for example, and/or to increase user enjoyment. An uppermost portion of the rail may be fixed to a framework or hung from ceiling joists or trees, for example, such that a region under the rail remains unobstructed for the trolley and the user to travel through. A typical rail includes a tube having an axial (also known as longitudinal) flange, for fixing or hanging, upstanding therefrom. The pulley is replaced by one or more freely-rolling wheels, that roll along the rail on an upper lateral portion or portions thereof, clear of the fixed uppermost portion. For example, the wheels may roll either side of the axial flange. The rail is generally inclined, having a mean gradient typically in a range from 1 in 10 to 1 in 60, though may include one or more descending portions, ascending portions and/or horizontal portions.

However, trolleys for rails may bind and hence brake on the rails, sometimes unexpectedly. This may result in injuries, such as whiplash injuries due to sudden deceleration, to the users. Further, the users may become stranded on the rails due to stopped trolleys, thereby requiring rescuing. Furthermore, following trolleys may collide with the stopped trolleys, also resulting in injuries. Increasing gradients of the rails, to reduce braking due to binding, otherwise increases speeds of the trolleys, which is contrary to a need to improve safety.

Hence, there is a need to improve trolleys for rails, for example to improve user safety and/or trolley reliability.

SUMMARY OF THE INVENTION

It is one aim of the present invention, amongst others, to provide a trolley, a rail assembly including a rail and a trolley and a kit of parts for a rail assembly including a rail and a trolley which at least partially obviates or mitigates at least some of the disadvantages of the prior art, whether identified herein or elsewhere. In this way, user safety and/or trolley reliability may be improved.

According to a first aspect, there is provided a trolley for a rail, the trolley comprising:

a frame;

a set of wheels, including a first wheel and a second wheel, rotatably coupled to the frame; and an attachment member, coupled to the frame, for attachment, preferably suspension, of a load therefrom, in use;

wherein the first wheel is rotatable in a first plane about a first axis and the second wheel is rotatable in a second plane about a second axis;

wherein the first plane and the second plane define a line;

wherein the trolley is arrangeable in:

a first configuration, wherein the attachment member is arranged at a first angular displacement about the line; and a second configuration, wherein the attachment member is arranged at a second angular displacement about the line, wherein the first angular displacement and the second angular displacement are different.

According to a second aspect, there is provided a rail assembly including a rail and the trolley according to the first aspect.

According to a third aspect, there is provided a kit of parts for a rail assembly including a rail and the trolley according to the first aspect.

DETAILED DESCRIPTION OF THE INVENTION

According to the present invention there is provided a trolley, as set forth in the appended claims. Also provided is a rail assembly and a kit of parts for a rail assembly. Other features of the invention will be apparent from the dependent claims, and the description that follows.

According to a first aspect, there is provided a trolley for a rail, the trolley comprising:

a frame;

a set of wheels, including a first wheel and a second wheel, rotatably coupled to the frame; and an attachment member, coupled to the frame, for attachment, preferably suspension, of a load therefrom, in use;

wherein the first wheel is rotatable in a first plane about a first axis and the second wheel is rotatable in a second plane about a second axis;

wherein the first plane and the second plane define a line;

wherein the trolley is arrangeable in:

a first configuration, wherein the attachment member is arranged at a first angular displacement about the line; and a second configuration, wherein the attachment member is arranged at a second angular displacement about the line, wherein the first angular displacement and the second angular displacement are different.

It should be understood that, in use, the load results in (i.e. gives rise to) a downwards vertical force due to gravity, which may be imposed, at least in part, on the rail via the trolley. The load may result in (i.e. give rise to) other forces, for example due to pitching, yawing and/or rolling of the load and/or due to centripetal forces on the load, as described below, that maybe imposed on the trolley and/or on the rail via the trolley. It should be understood that the rail is generally inclined, having a mean gradient typically in a range from 1 in 10 to 1 in 60, though may include one or more descending portions, ascending portions and/or horizontal portions. For example, a rail may include an initial length having a mean gradient of about 1 in 13 (to accelerate the trolley initially), followed by an intermediate length having a mean gradient of about 1 in 25 (corresponding approximately with constant speed of the trolley) and a final length having a mean gradient of about 1 in 50 (to decelerate the trolley).

The inventors have determined that conventional trolleys may bind and hence brake on the rails, sometimes unexpectedly, due to increased transverse forces (i.e. lateral forces, transverse to the line) on the rails. These increased lateral forces on the rails may be due to centripetal forces when the trolleys travel round curved portions of the rails and/or due to oscillations of the loads, such as users swinging from side to side. Unexpected binding and hence braking is typically due to the users swinging from side to side, which may be neither anticipated nor prevented.

Since the attachment member is moveable between the first configuration and the second configuration, transverse forces on the rail may be reduced compared with a fixed attachment member, for example. In this way, a likelihood of the trolley binding and hence braking on the rail is reduced. In this way, a likelihood of injury and/or stranding of users may be reduced. In this way, user safety and/or trolley reliability may be improved.

Furthermore, since the transverse forces on the rail may be reduced compared with a fixed attachment member, for example, a number of wheels included in the set of wheels and/or a size of the wheels included in the set of wheels may be reduced, as described below in more detail. Additionally and/or alternatively, a strength of the frame may be reduced. In this way, a weight and/or cost of the trolley may be reduced. For example, a mass reduction of the trolley from about 4.8 kg to about 3.7 kg (i.e. about 22%) may be achieved due to the reduced transverse forces. Conversely, an increased load may be attached to the trolley.

Load

Typically, the load comprises and/or is a user, having a mass in a range from 30 kg to 120 kg and hence a weight in a range from 294 N to 1,177 N. In addition, centripetal forces due to cornering may add up to 1.5 g horizontally (i.e. up to 441 N to 1,766 N). Furthermore, an increased vertical load due to down swing (for example, the user swinging from an incline to a vertical position) may add up to 0.6 g vertically (i.e. up to i.e. up to 176 N to 706 N) with no horizontal component. The user may be attached to the attachment member via a harness (also known as a suspension harness), for example.

The harness may be include a dorsal D-ring, for example, for attaching to the attachment member via a sling or lanyard. In this way, in use, the user may be suspended in a hang glider-type (also known as a superman) position (i.e. prone or face down). The trolley may include a handle, for the user to hold when in such a prone or face-down position.

Trolley

The trolley (also known as a bogey) is suitable for use with the rail (also known as a track) and is arranged to roll thereon. Generally, the trolley is retained on the rail, for example by the set of wheels, so that the trolley may not be removed from (i.e. come off) the rail, in use.

The trolley comprises the frame, to which the set of wheels are rotatably coupled and to which the attachment member is coupled. That is, the frame transfers forces due to the load to at least one of the wheels of the set of wheels, for example the first wheel and/or the second wheel. In one example, the frame comprises an open structure (also known as a framework or cage), for example provided by one or more struts and/or one or more ties. In one example, the frame comprises a closed structure and/or a monocoque structure. In one example, the frame comprises a passageway for the rail to pass therethrough.

Set of Wheels

The trolley comprises the set of wheels, including the first wheel and the second wheel, rotatably coupled to the frame. Forces due, at least in part, to the load are transferred via the frame to at least one of the wheels of the set of wheels, for example the first wheel and/or the second wheel.

In one example, the first wheel and the second wheel are arranged to roll on an upper and/or lateral portion or portions of the rail and thereby transfer, at least in part, a weight due to the load on to the rail and/or forces due to movement, for example pitching and/or yawing, of the load on to the rail. In one example, the first wheel and the second wheel are arranged at opposed ends of the frame. In one example, the first wheel and the second wheel are arranged at a same end of the frame. In one example, the first wheel and the second wheel are arranged on opposed sides of the passageway therein, whereby the first wheel and the second wheel are arranged, in use, on opposed sides of the rail. In one example, the set of wheels includes a third wheel, as described with respect to the first wheel and/or the second wheel, wherein the first wheel and the second wheel are arranged at opposed ends of the frame and wherein the third wheel is arranged on an opposed side of the passageway therein, whereby the first wheel (and the second wheel) and the third wheel are arranged, in use, on opposed sides of the rail. In one example, the set of wheels includes a third wheel and a fourth wheel, as described with respect to the first wheel and the second wheel, respectively. In one example, the first wheel and the second wheel are arranged at opposed ends of the frame, the third wheel and the fourth wheel are arranged at opposed ends of the frame, the first wheel and the third wheel are arranged on opposed sides of the passageway therein and the second wheel and the fourth wheel are arranged on opposed sides of the passageway therein.

In one example, the set of wheels is arranged to retain the trolley on the rail, so that the trolley may not be removed from (i.e. come off) the rail, in use. In other words, the trolley is captive on the rails, thereby improving safety.

In one example, the set of wheels is arranged to resist, at least in part, forces in 1, 2 or 3 mutually orthogonal directions, for example due to the weight of the load and/or pitching, rolling and/or yawing of the trolley. In one preferred example, the set of wheels is arranged to resist, at least in part, forces in 2 mutually orthogonal directions, for example due to the weight of the load and/or pitching, rolling and/or yawing of the trolley, while permitting movement of the trolley in a third mutually orthogonal direction, for example along, down and/or up the rail.

In one example, the set of wheels includes 3 or more wheels.

Subsets of Wheels

In one example, the set of wheels includes a first subset of wheels, including the first wheel, the second wheel and optionally, the third wheel and/or the fourth wheel. In one example, the first subset of wheels includes more than four wheels. In one example, the first subset of wheels are arranged to roll on an upper and/or lateral portion or portions of the rail and thereby transfer, at least in part, a weight due to the load on to the rail and/or forces due to movement, for example pitching and/or yawing, of the load on to the rail. In this way, pitching and/or yawing of the trolley about the rail may be resisted. In one example, the set of wheels includes a second subset of wheels, including a fifth wheel and optionally, a sixth wheel, a seventh wheel and/or an eighth wheel. In one example, the second subset of wheels includes more than four wheels. In one example, the second subset of wheels are arranged to roll on a lower and/or lateral portion or portions of the rail and thereby transfer, at least in part, forces due to movement, for example pitching and/or yawing, of the load on to the rail. In this way, pitching and/or yawing of the trolley about the rail may be resisted. In one example, the set of wheels includes a third subset of wheels, including a ninth wheel and optionally, a tenth wheel. In one example, the third subset of wheels includes more than two wheels. In one example, the third subset of wheels are arranged to roll on a lateral portion or portions of the rail and thereby transfer, at least in part, forces due to movement, for example rolling, of the load on to the rail. In this way, rolling of the trolley about the rail may be resisted. That is, the wheels of the second subset of wheels and/or the third subset of wheels improve stability, in use, and may be referred to as stability wheels. In one example, the wheels included in the second subset of wheels and/or the third subset of wheels are relatively smaller and/or lighter than those included in the first subset of wheels. Particularly, since the transverse forces on the rail may be reduced compared with a fixed attachment member, for example, a size and/or weight of these wheels included in the second subset of wheels and/or the third subset of wheels may be reduced.

In one example, in use, one or more or all of the wheels of a subset of wheels, including the first wheel and the second wheel, are generally in contact with the rail. In one example, in use, one or more or all of the wheels of a subset and/or a subset of wheels are generally not in contact with the rail, spaced apart therefrom by a gap in a range from 1 mm to 10 mm, preferably in a range from 3 mm to 7 mm, but may contact the rail during yawing, pitching and/or rolling of the trolley.

In one example, the third wheel is rotatable in the first plane about a third axis parallel to the first axis and the fourth wheel is rotatable in the second plane about a fourth axis parallel to the second axis, wherein the first plane and the second plane define the line. In one example, the wheels included in the first subset of wheels define the line. In one example, the wheels included in the first subset of wheels and the second subset of wheels define the line.

Wheel Orientation

The first wheel is rotatable in the first plane about the first axis and the second wheel is rotatable in the second plane about the second axis, wherein the first plane and the second plane define the line.

In one example, the first axis and the second axis are coaxial, whereby the first plane and the second plane are coplanar or parallel. If the first plane and the second plane are coplanar, the line is defined in the first plane and the second plane. If the first plane and the second plane are parallel, the line is defined between the first plane and the second plane, for example equidistant therefrom. In one example, the first axis and the second axis are mutually inclined, whereby the first plane and the second plane are mutually inclined. If the first plane and the second plane are mutually inclined, the line is defined by the intersection of the first plane and the second plane. In one example, the line is the intersection of the first plane and the second plane. In one preferred example, the line is the intersection of the first plane and the second plane and the rail comprises a cylindrical running surface defining a cylinder axis, wherein the line is substantially coincident, in use, with the cylinder axis. In one example, the line is substantially coincident, in use, with the cylinder axis when the line is within 20%, preferably within 15%, more preferably within 10%, most preferably within 5% of the cylinder axis as a percentage of a radius of the cylindrical running surface.

In one example, the first axis and/or the second axis is tangential to a radius normal to the line.

Wheel

In one example, the first wheel comprises a tyre formed from a polymeric composition, for example a thermoplastic such as polyurethane or nylon, having one or more bearings, for example ball bearings such as deep-groove ball bearings, therein. Polyurethane is preferred, In one example, the bearings are sealed (i.e. having a seal, also known as a shield or a closure), thereby reducing a maintenance requirement and/or improving safety. Type ZZ, 2RS and/or 2RU seals are preferred. In one example, the first wheel (for example, a tyre thereof) has an outside diameter in a range from 40 mm to 80 mm, preferably in a range from 50 mm to 70 mm. Smaller wheels tend to provide greater stability and accelerate more quickly while larger wheels are smoother over rougher surfaces and are suitable for higher speeds. In one example, the first wheel (for example, a tyre thereof) has a hardness in a range from 70*a* to 110*a* (as determined using a durometer). Softer wheels (e.g. 70*a*) have better grip while harder wheels (e.g. 100*a*) are faster. In one example, the first wheel is a plain wheel (i.e. having a cylindrical rolling surface), thereby having a relatively large contact patch (i.e. surface area). In one example, the first wheel has a width in a range from 5 mm to 40 mm, preferably in a range from 10 mm to 30 mm.

In one preferred example, the first wheel comprises a polyurethane roller, for example having an outside diameter of 62 mm, bonded to a deep-groove ball bearing, for example a SKF 6301 ZZ deep-groove ball bearing having a 12 mm bore and a 12 mm length.

In one example, the first wheel is mounted on an axle, wherein the axle is fastened to the frame. In one example, the axle comprises and/or is a mechanical fastener, for example a threaded fastener such as a bolt, fastened to the frame, for example using a nut or screwed into a tapped hole in the frame. In one example, the first wheel comprises an adjustable first wheel. In this way, a clearance of the first wheel from the rail may be adjusted, for example to account for wear of the first wheel and/or the rail, and/or to apply a pre-load to the first wheel, so as to control pitching, rolling or yawing of the trolley, for example. In one example, the axle comprises an eccentric axle, whereby the first wheel comprises an adjustable first wheel.

In one example, the first wheel is a passive wheel (i.e. not driven). In one example, the first wheel is an active wheel (i.e. driven). In one example, the trolley comprises an actuator, for example an electric motor and optionally, a power supply and/or a power controller, arranged to drive the first wheel.

The second wheel may be as described with respect to the first wheel. Each wheel of the subset of wheels may be as described with respect to the first wheel. In one example, the wheels included in the second subset of wheels and/or the third subset of wheels are relatively smaller and/or lighter than those included in the first subset of wheels. In one example, the wheels included in the second subset of wheels and/or the third subset of wheels have outside diameters in a range from 20 mm to 60 mm, preferably in a range from 30 mm to 50 mm. In one example, the wheels included in the second subset of wheels and/or the third subset of wheels have widths in a range from 5 mm to 30 mm, preferably in a range from 10 mm to 20 mm.

Attachment Member

The trolley comprises the attachment member, coupled to the frame, for attachment, preferably suspension, of the load therefrom, in use. In this way, the load may be attached, preferably suspended, from the frame.

In one example, the attachment member is releasably coupled to the frame. In one example, release of the attachment member from the frame requires a use of a tool. In this way, inadvertent or deliberate release of the attachment member, in use, may be avoided, thereby improving safety. In one example, the attachment member comprises a fastener, for example a pin fastener, a split pin (also known as a cotter pin, cotter key or a split cotter), a locking ring, a mouse, or a clamp to restrict release of the attachment member from the frame. In this way, inadvertent or deliberate release of the attachment member, in use, may be avoided, thereby improving safety. In one example, the attachment member comprises a shackle (also known as a gyve), being generally a U-shaped piece of metal secured with a clevis pin or bolt across the opening thereof, or a hinged metal loop secured with a quick-release locking pin mechanism. In one example, the shackle is a bow shackle, a D-shackle, a headboard shackle, a pin shackle, a snap shackle, a threaded shackle or a twist shackle. A pin shackle, closed with an anchor bolt and a split pin and including a securing nut in addition to the split pin, is preferred, since inadvertent or deliberate release of the attachment member, in use, may be avoided. A moused threaded shackle is also suitable. Quick release shackles, for example snap shackles or carabiners, may be readily released, in use, even with one hand and are generally not preferred. Generally, quick release attachment members are not preferred. In one example, the attachment member does not comprise and/or is not a quick release attachment member, for example a quick release shackle.

First Configuration and Second Configuration

The trolley is arrangeable in:

the first configuration, wherein the attachment member is arranged at the first angular displacement about the line; and the second configuration, wherein the attachment member is arranged at the second angular displacement about the line, wherein the first angular displacement and the second angular displacement are different.

As described above, since the attachment member is moveable between the first configuration and the second configuration, transverse forces on the rail may be reduced compared with a fixed attachment member, for example. In this way, a likelihood of the trolley binding and hence braking on the rail is reduced. In this way, a likelihood of injury and/or stranding of users may be reduced. In this way, user safety and/or trolley reliability may be improved.

In one example, a height or elevation of the attachment member at the second angular displacement is greater than that at the first angular displacement. That is, a second gravitational potential energy of the load when the trolley is arranged in the second configuration is greater than a first gravitational potential energy of the load when the trolley is arranged in the first configuration. That is, work must be done to move the attachment member from the first configuration to the second configuration. In this way, movement of the load and hence the attachment member transverse to the line may be controlled, for example moderated.

In one example, the trolley is arranged to move from the first configuration to the second configuration due to a force transverse to the line (i.e. a lateral force, a transverse force) due, at least in part, movement of the load transverse to the line. For example, the load may move transversely to the line due to centripetal forces thereon when the trolley travels round a curved portion of the rail. For example, the load may move transversely to the line due to oscillation of the load, such as a user swinging from side to side (i.e. rolling of the trolley).

In one example, the attachment member is arranged to move from the first angular displacement to the second angular displacement in an arc, for example of increasing height or elevation, about the line. In this way, movement of attachment member may be smooth, enhancing user experience and/or safety, while work must be done to move the attachment member from the first configuration to the second configuration, as described above. In one preferred example, the rail comprises a cylindrical running surface defining a cylinder axis, wherein the line is substantially coincident, in use, with the cylinder axis, wherein the attachment member is arranged to move from the first angular displacement to the second angular displacement in an arc about the line and wherein the arc is concentric with the cylindrical running surface.

In one example, the trolley comprises a mechanical linkage, coupled to the frame, and the attachment member is coupled to the mechanical linkage. In one example, the mechanical linkage comprises a planar four-bar linkage, for example a planar quadrilateral linkage. In this way, the attachment member may be arranged to move from the first angular displacement to the second angular displacement in an arc, for example of increasing height or elevation, about the line.

In one example, the attachment member is arranged to rotate about the line whereby, in the first configuration, the attachment member is arranged at a first angular rotation about the line; and whereby in the second configuration, the attachment member is arranged at a second angular rotation about the line, wherein the first angular rotation and the second angular rotation are different.

Guide

In one example, the trolley comprises a guide coupled to the frame, arranged to guide the attachment member between the first configuration and the second configuration. In this way, movement of the attachment member may be guided, for example controlled, restricted and/or constrained. In one example, the guide comprises an arcuate portion. In this way, the attachment member may be arranged to move from the first angular displacement to the second angular displacement in an arc, for example of increasing height or elevation, about the line. In one example, the arc subtends an angle in a range from 15° to 270°, preferably in a range from 45° to 180°, more preferably in a range from 60° to 120°, for example about 90° or about 100°. In one example, the guide has a circular cross-section, whereby the guide comprises and/or is a round bar or a round tube. In one example, the guide has a diameter in a range from 5 mm to 50 mm, preferably in a range from 10 mm to 20 mm. Round bar may be readily formed to comprise an arcuate portion, for example. In one example, the guide is formed from a material having a hardness (Rockwell B) in a range from 50 HRB to 100 HRB (1/16" ball 100 kg), a yield strength in a range from 150 MPa to 400 MPa, an elongation at break in a range from 10% to 80%, a modulus of elasticity in a range from 150 to 400 GPa and/or a Charpy impact (EN 10045-1) in a range from 100 J to 500 J. Corrosion resistance is preferred. Stainless steel SAE Types 304 and 316 (preferred) are suitable.

In one example, the attachment member comprises a shackle and the shackle is arranged to slide on the guide. The guide may be lubricated, for example with grease, molybdenum disulphide and/or polytetrafluoroethylene (PTFE), and/or a plain bearing may be included, for example a phosphor bronze, a cast iron or a polytetrafluoroethylene (PTFE) plain bearing.

Roller

In one example, the attachment member comprises a roller arranged to roll on the guide. In this way, the trolley is arranged to move from the first configuration to the second configuration, for example in an arc, by rolling of the attachment member on the guide. In this way, resistance to movement of the attachment member due to friction between the attachment member and the guide may be reduced. In this way, wear of the guide and/or the attachment member may be reduced, compared with sliding of the attachment member, thereby reducing a maintenance requirement and/or improving safety. In one example, the attachment member comprises one or more bearings, for example ball bearings such as deep-groove ball bearings, and the roller is mounted thereon. In this way, resistance to movement of the attachment member due to friction between the attachment member and the guide may be further reduced. In one example, the bearings are sealed (i.e. having a seal, also known as a shield or a closure), thereby reducing a maintenance requirement and/or improving safety. Type ZZ, 2RS and/or 2RU seals are preferred. In one example, the attachment member comprises one or more spacers, for example washers, arranged beside the bearings, for example to space apart the bearings from the legs of a shackle.

In one example, the roller is a grooved roller, for example having a circumferential groove, such as a circumferential radiused groove. In one example, the roller has a maximum outside diameter in a range from 20 mm to 50 mm, preferably in a range from 30 mm to 40 mm. In one example, the roller is a grooved roller, having a circumferential radiused groove, and the guide has a circular-cross section. In one example, a radius of the groove corresponds with a radius of the guide. In one example, the radius of the grove is at least the radius of the guide. In one example, the radius of the groove is larger than the radius of the guide, for example in a range of 1% to 20%, preferably in a range from 3% to 10%. In this way, the attachment member is rotatable about a normal to the line, while maintaining a sufficiently large contact area between the roller and the guide, so as to reduce contact stresses thereon.

In one preferred example, the attachment member comprises a pin shackle, closed with an anchor bolt and a split pin and including a securing nut in addition to the split pin, and a grooved roller, having a circumferential radiused groove, wherein the grooved roller comprises two ball bearings, wherein the grooved roller is mounted on the anchor bolt between the legs of the shackle, spaced apart therefrom by two spacers.

In one example, the attachment member is rotatable about a normal to the line provided, for example, by the radius of the groove being larger than the radius of the guide, or a swivel, such as a swivel shackle. Other means of providing such rotation are known. In this way, twisting of the load relative to the trolley may be accommodated.

In one example, the roller is formed from a material having a hardness (Rockwell B) in a range from 50 HRB to 100 HRB (1/16" ball 100 kg), a yield strength in a range from 150 MPa to 600 MPa, an elongation at break in a range from 10% to 80%, a modulus of elasticity in a range from 150 to 600 GPa, a Charpy impact (EN 10045-1) in a range from 100 J to 500 J, and/or a fatigue limit in a range from 100 MPa to 500 MPa, preferably in a range from 200 MPa to 400 MPa. Particularly, the inventors have determined that repeated rolling of the roller on the guide and/or the relatively high contact stresses due to the relatively small contact area between the roller and the guide, may result in failure, for example cracking, of the roller and/or the guide. Without wishing to be bound by any theory, it is understood that the repeated rolling, combined with the relatively high contact stresses, results in fatigue crack initiation and/or growth. Corrosion resistance is preferred. Stainless steel SAE Types 304 and 316 (preferred) are suitable. The roller may be coated or polished, for example, to improve fatigue resistance.

Plurality of Attachment Members and/or Guides

In one example, the trolley comprises plurality of attachment members and/or guides, for example a corresponding plurality of guides, each attachment member and guide as described above. In one example, the trolley comprises two attachment members and two guides.

Rail Assembly

According to a second aspect, there is provided a rail assembly including a rail and the trolley according to the first aspect.

As described above, it should be understood that the rail is generally inclined though may include one or more of a descending portion, an ascending portion and a horizontal portion. In one example, the rail comprises a descending portion, an ascending portion and/or a horizontal portion.

In one example, the rail comprises a non-linear, for example a curved, portion. In this way, the non-linear portion enables the rail to curve around obstacles, for example, and/or to increase user enjoyment, as described above. It should be understood that the non-linear portion is generally sideways, though the rail may curve sideways and up or down also.

In one example, the rail comprises two or more rails, for example two parallel rails. In one example, the rail is a monorail (i.e. a single rail). A monorail is preferred, reducing cost and/or weight, may be fixed readily to a framework or hung from ceiling joists or trees, for example, and/or may be formed into relatively complex shapes, including multiple non-linear and linear portions that may also ascend, descend and/or be horizontal.

In one example, the rail comprises a planar (i.e. a flat) running surface, for example provided by a square or rectangular bar or hollow section and/or by an equal or unequal angle section. In one example, the rail comprises a non-planar, for example a convex or a concave running surface. In one example, the rail comprises a cylindrical (i.e. a convex) running surface defining a cylinder axis, wherein the line is substantially coincident, in use, with the cylinder axis, for example provided by a tube (i.e. a section) having a circular cross-section or a part thereof, such as a U shape channel. Hollow section is preferred, reducing a weight of the rail. In one example, the tube has an outside diameter in a range from 40 mm to 100 mm, preferably in a range from 50 mm to 75 mm, and/or a wall thickness in a range from 1 mm to 6 mm, preferably in a range from 2 mm to 5 mm, for example 3 mm or 4 mm.

In one example, the rail comprises a longitudinal flange (i.e. a fixing means). In this way, the rail may be fixed to a framework or hung from ceiling joists or trees, for example, such that a region under the rail remains unobstructed for the trolley and the user to travel through. In one example, the longitudinal flange extends continuously along a length of the rail. In one example, the longitudinal flange comprises one or more perforations or brackets, for fixing. Other fixing means are known. In one example, the flange is welded to the section, for example continuously or intermittently.

In one example, the rail is formed from steel according to EN 10025: part 2: 2004 grade S185, S235, S275, S355 or equivalent. In one example, the rail is coated, for example painted and/or galvanized, to improve corrosion resistance.

In one example, the rail is provided in lengths that are coupled end to end, for example on site.

In one preferred example, the rail comprises a cylindrical running surface defining a cylinder axis, wherein the line is substantially coincident, in use, with the cylinder axis, for example provided by a tube having a circular cross-section and the rail comprises a longitudinal flange normal to the tube (i.e. upstanding therefrom) extending continuously along the tube.

According to a third aspect, there is provided a kit of parts for a rail assembly including a rail and the trolley according to the first aspect.

The rail may be as described with respect to the second aspect.

Throughout this specification, the term "comprising" or "comprises" means including the component(s), unit(s), module(s), feature(s) or integer(s) specified but not to the exclusion of the presence of other components, units, modules, features or integers.

The term "consisting of" or "consists of" means including the component(s), unit(s), module(s), feature(s) or integer(s) specified but excluding other components, units, modules, features or integers.

Whenever appropriate, depending upon the context, the use of the term "comprises" or "comprising" may also be taken to include the meaning "consists essentially of" or "consisting essentially of", and also may also be taken to include the meaning "consists of" or "consisting of".

The optional features set out herein may be used either individually or in combination with each other where appropriate and particularly in the combinations as set out in the accompanying claims. The optional features for each aspect or exemplary embodiment of the invention, as set out herein are also applicable to all other aspects or exemplary embodiments of the invention, where appropriate. In other words, the skilled person reading this specification should consider the optional features for each aspect or exemplary embodiment of the invention as interchangeable and combinable between different aspects and exemplary embodiments.

BRIEF DESCRIPTION OF THE DRAWINGS

For a better understanding of the invention, and to show how exemplary embodiments of the same may be brought into effect, reference will be made, by way of example only, to the accompanying diagrammatic Figures, in which:

FIGS. 11A to 11C schematically depict a perspective view, an end view and a side view, respectively, of the guide of the trolley of FIG. 1, in more detail;

DETAILED DESCRIPTION OF THE DRAWINGS

Figure 1:
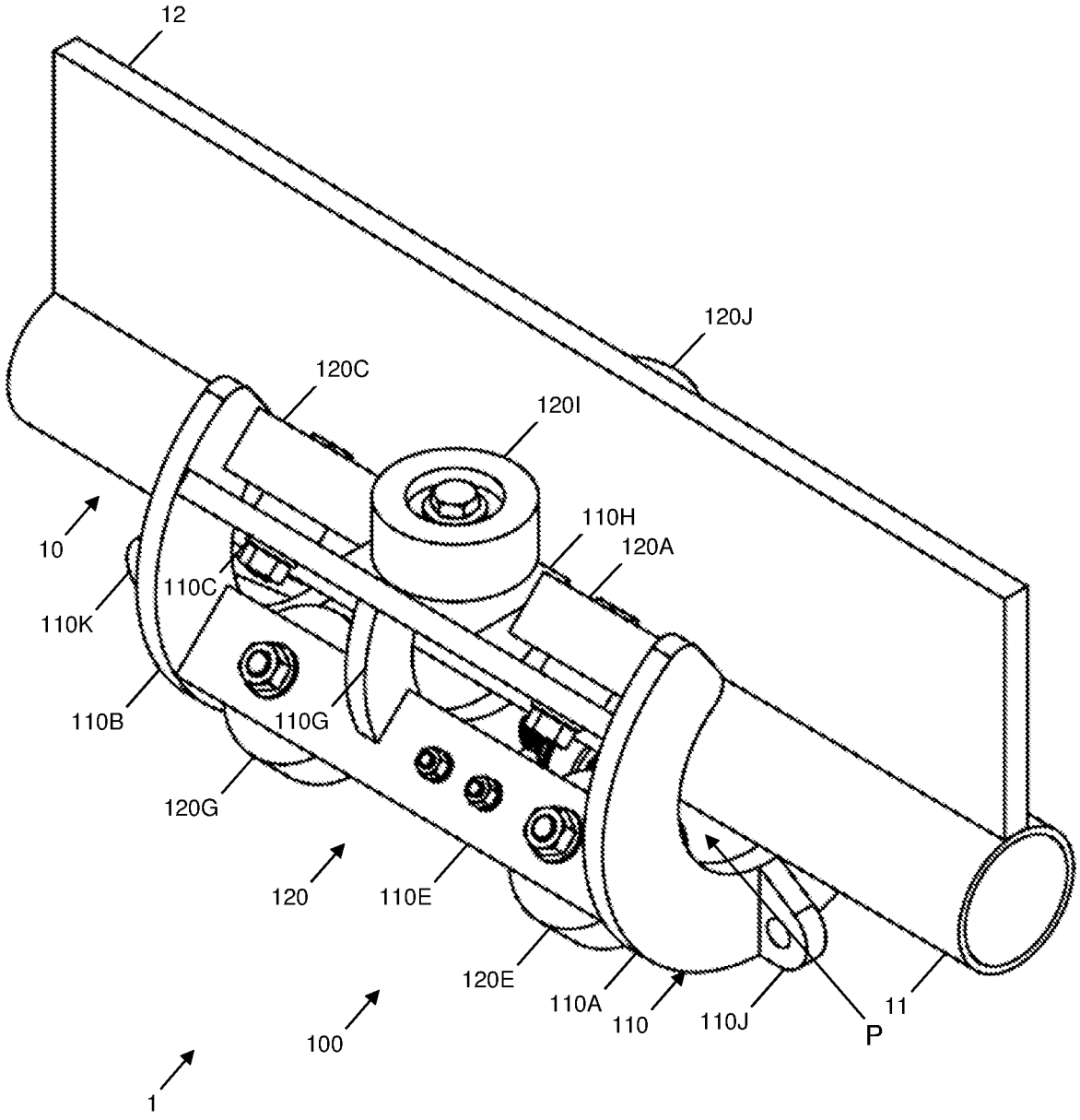
FIG. 1 schematically depicts a perspective view of a rail assembly according to an exemplary embodiment, including a trolley according to an exemplary embodiment.
Figure 2:
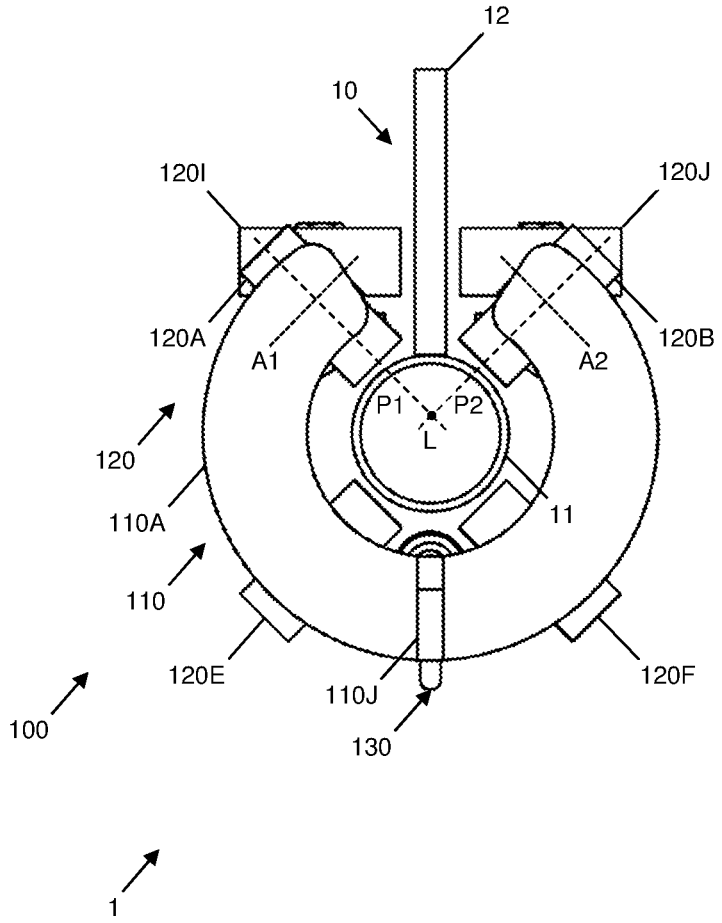
FIG. 2 schematically depicts an end view of the rail assembly of FIG. 1.
Figure 3:
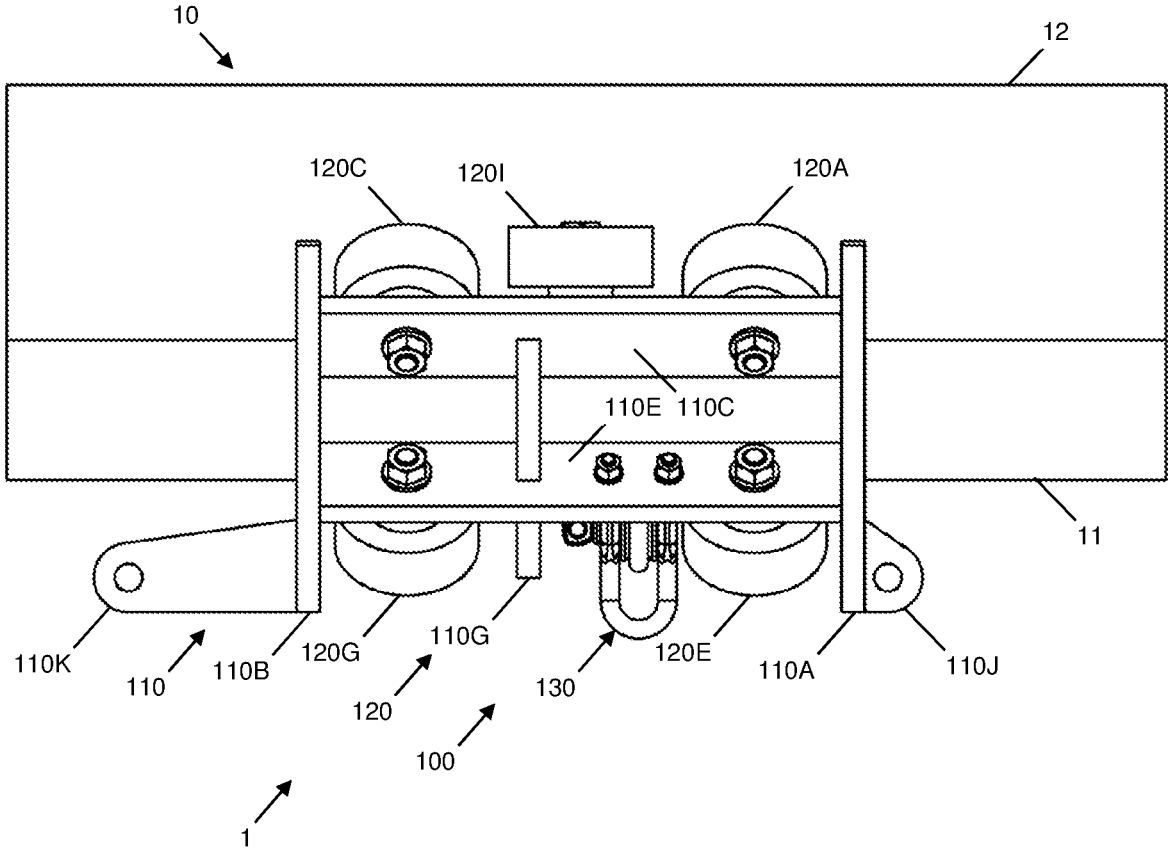
FIG. 3 schematically depicts a side view of the rail assembly of FIG. 1.
Figure 4:
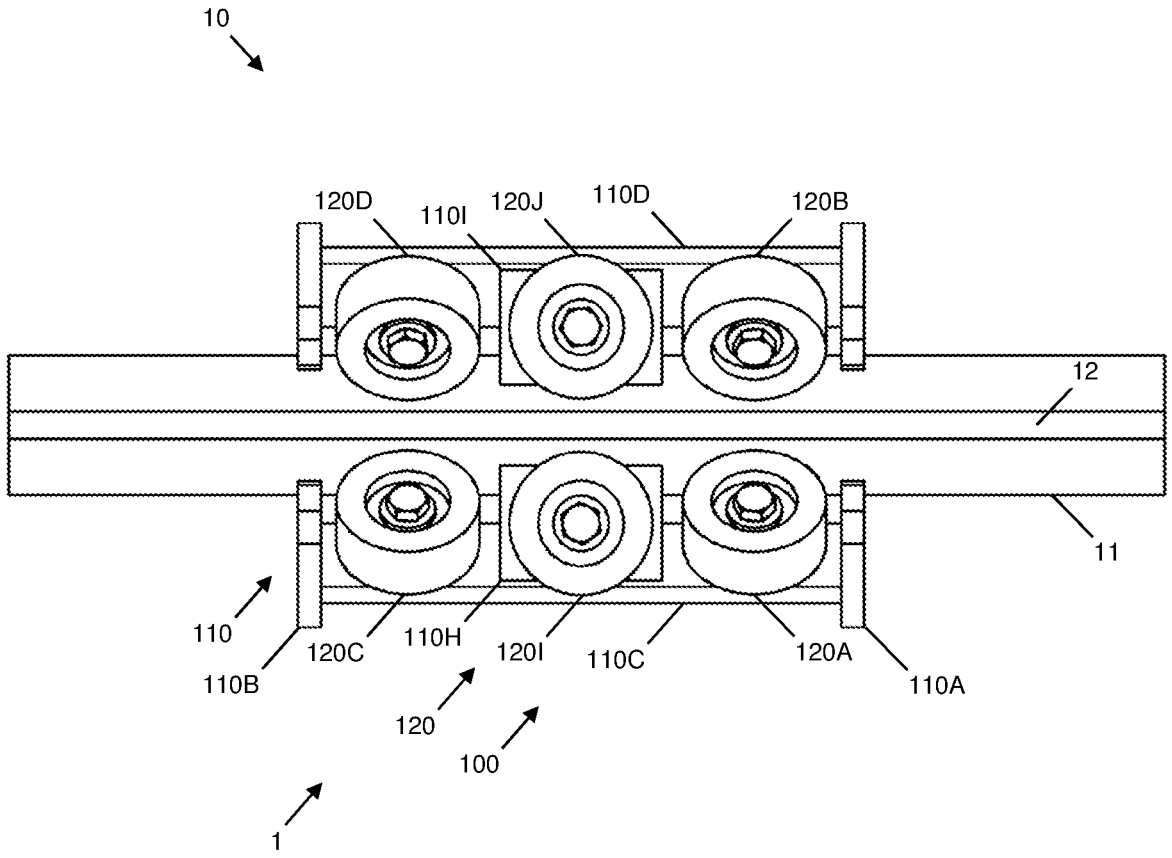
FIG. 4 schematically depicts a plan view of the rail assembly of FIG. 1.
Figure 5:
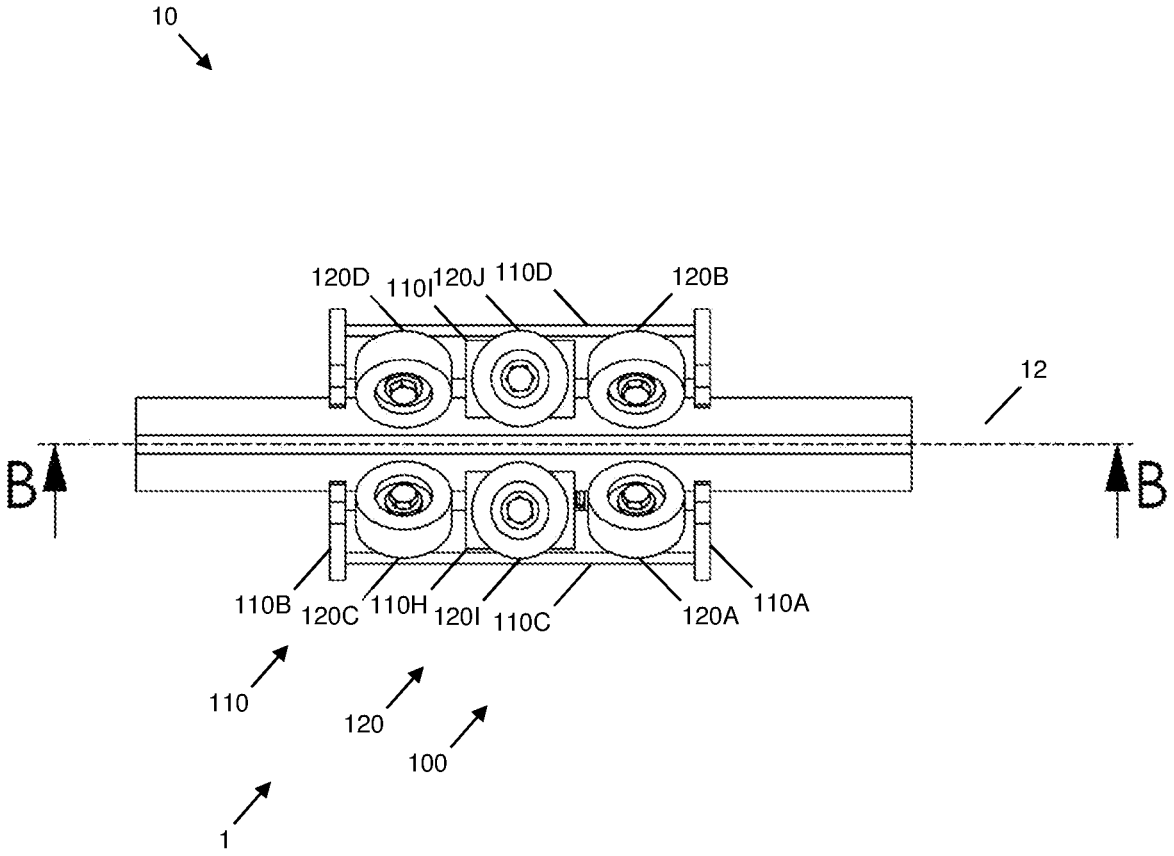
FIG. 5 schematically depicts a plan view of the rail assembly of FIG. 1.
Figure 6:
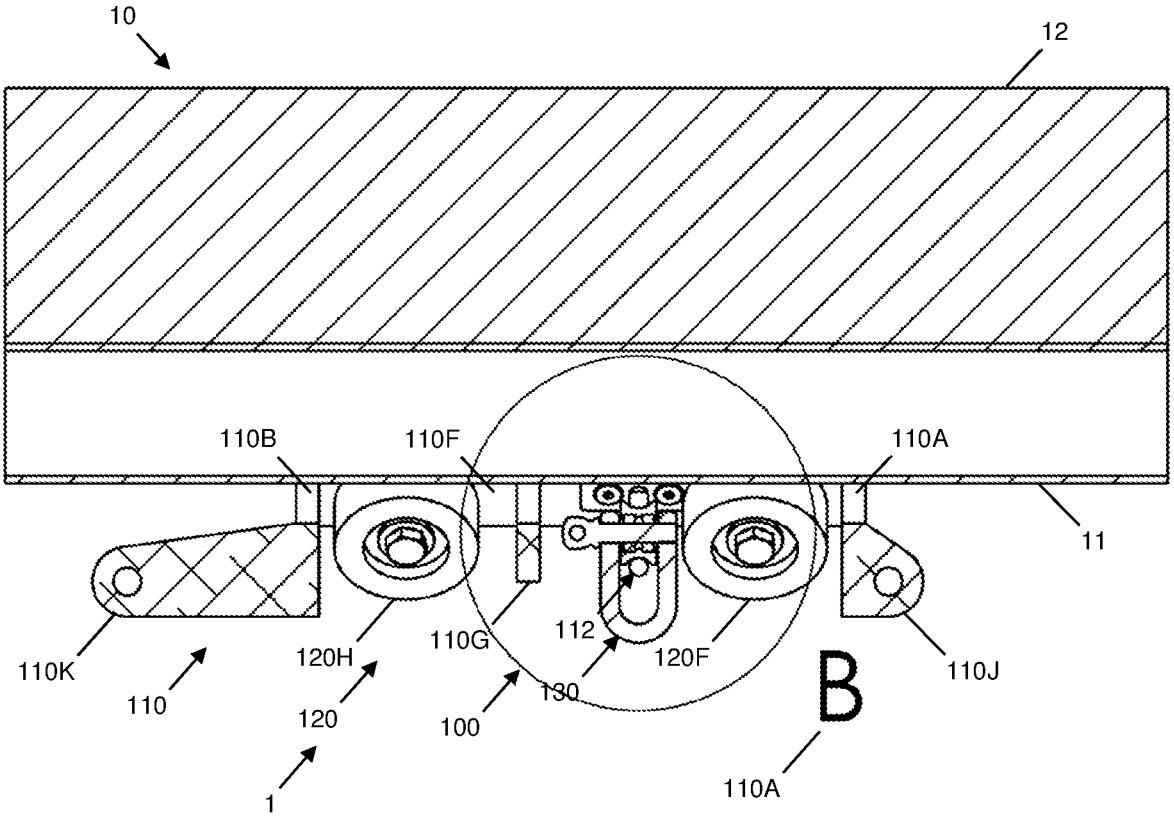
FIG. 6 schematically depicts a longitudinal cross-sectional view of the rail assembly of FIG. 5.
Figure 7:
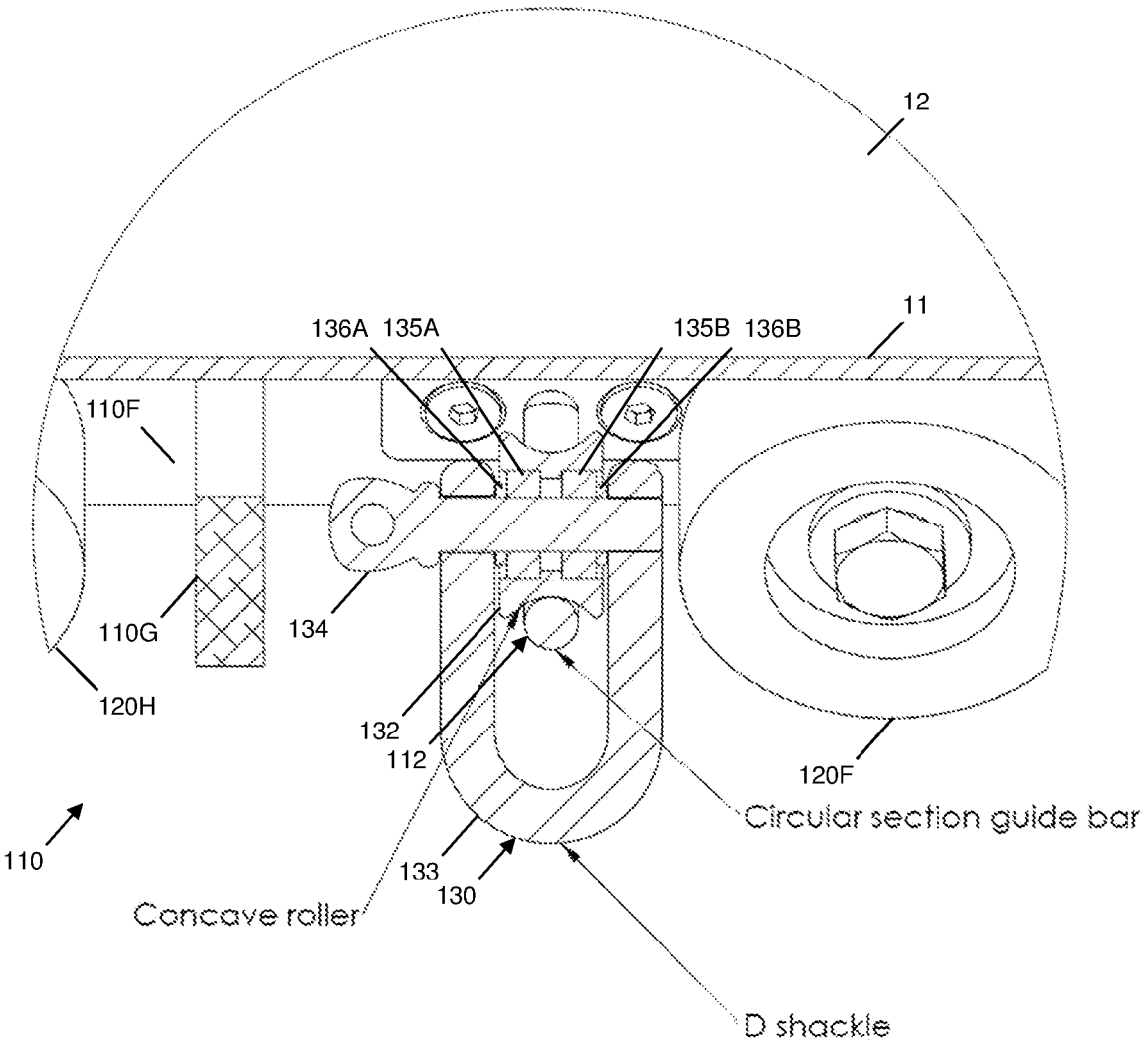
FIG. 7 schematically depicts a longitudinal cross-sectional view of the rail assembly of FIG. 5, in more detail.
Figure 8:
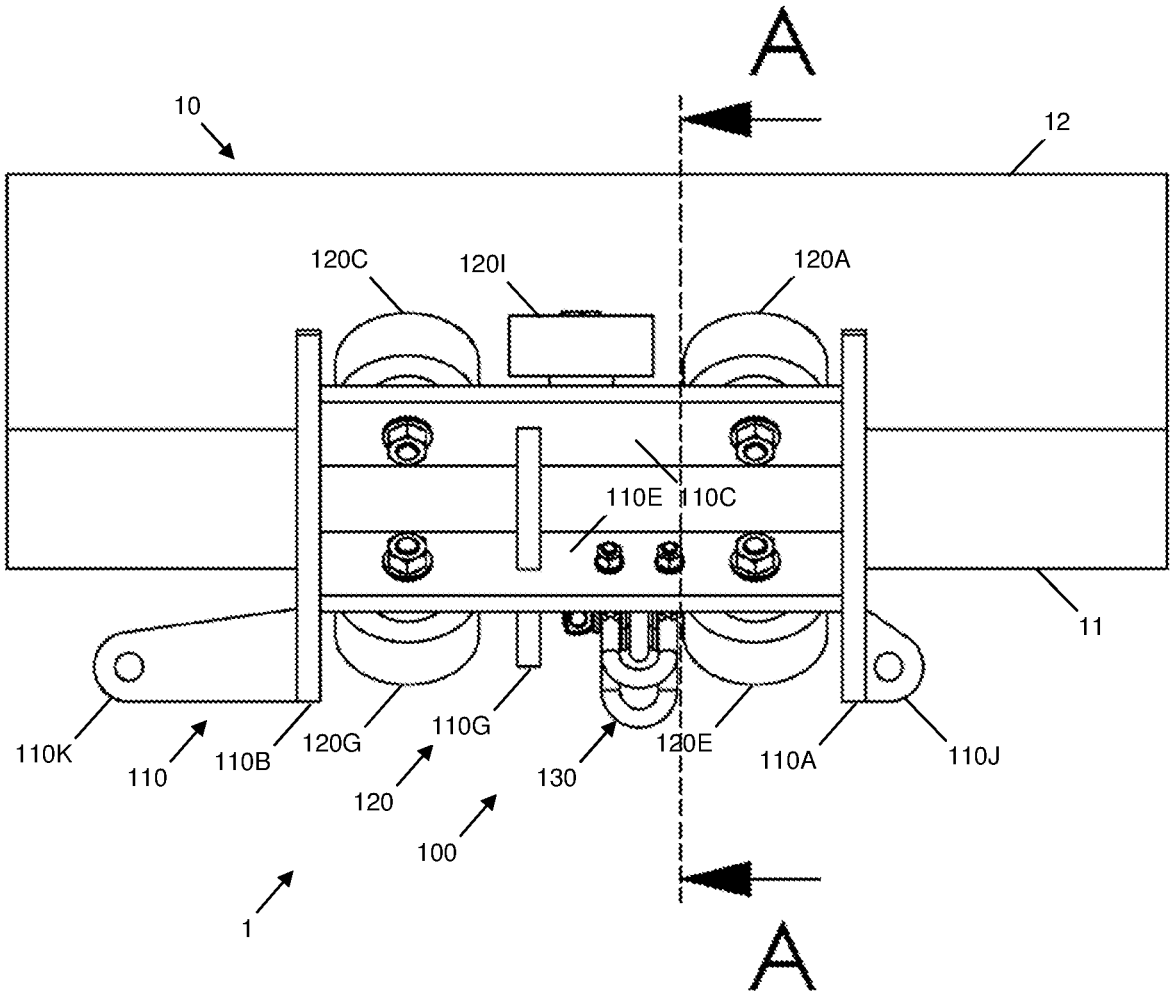
FIG. 8 schematically depicts a side view of the rail assembly of FIG. 1.
Figure 9:
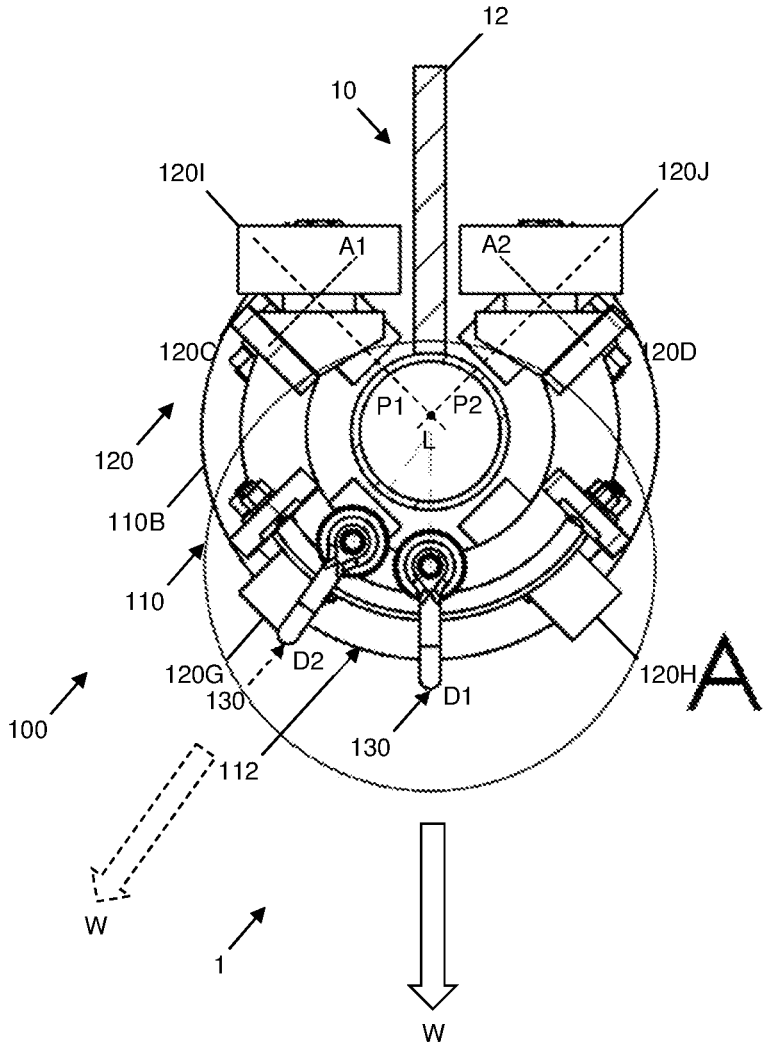
FIG. 9 schematically depicts a transverse cross-sectional view of the rail assembly of FIG. 8, in the first configuration and in the second configuration.
Figure 10:
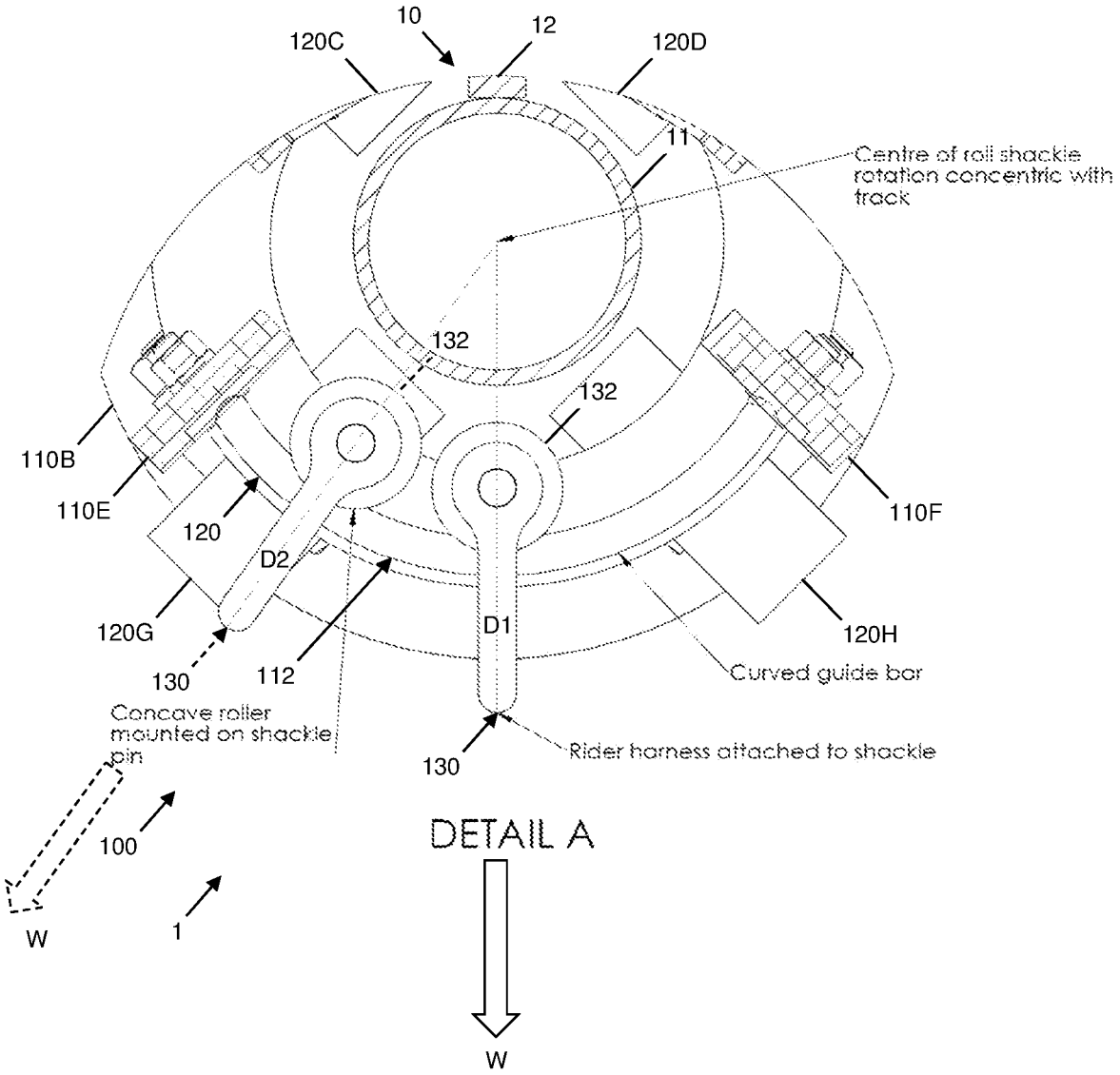
FIG. 10 schematically depicts a transverse cross-sectional view of the rail assembly of FIG. 8, in the first configuration and in the second configuration, in more detail.
Figure 13:
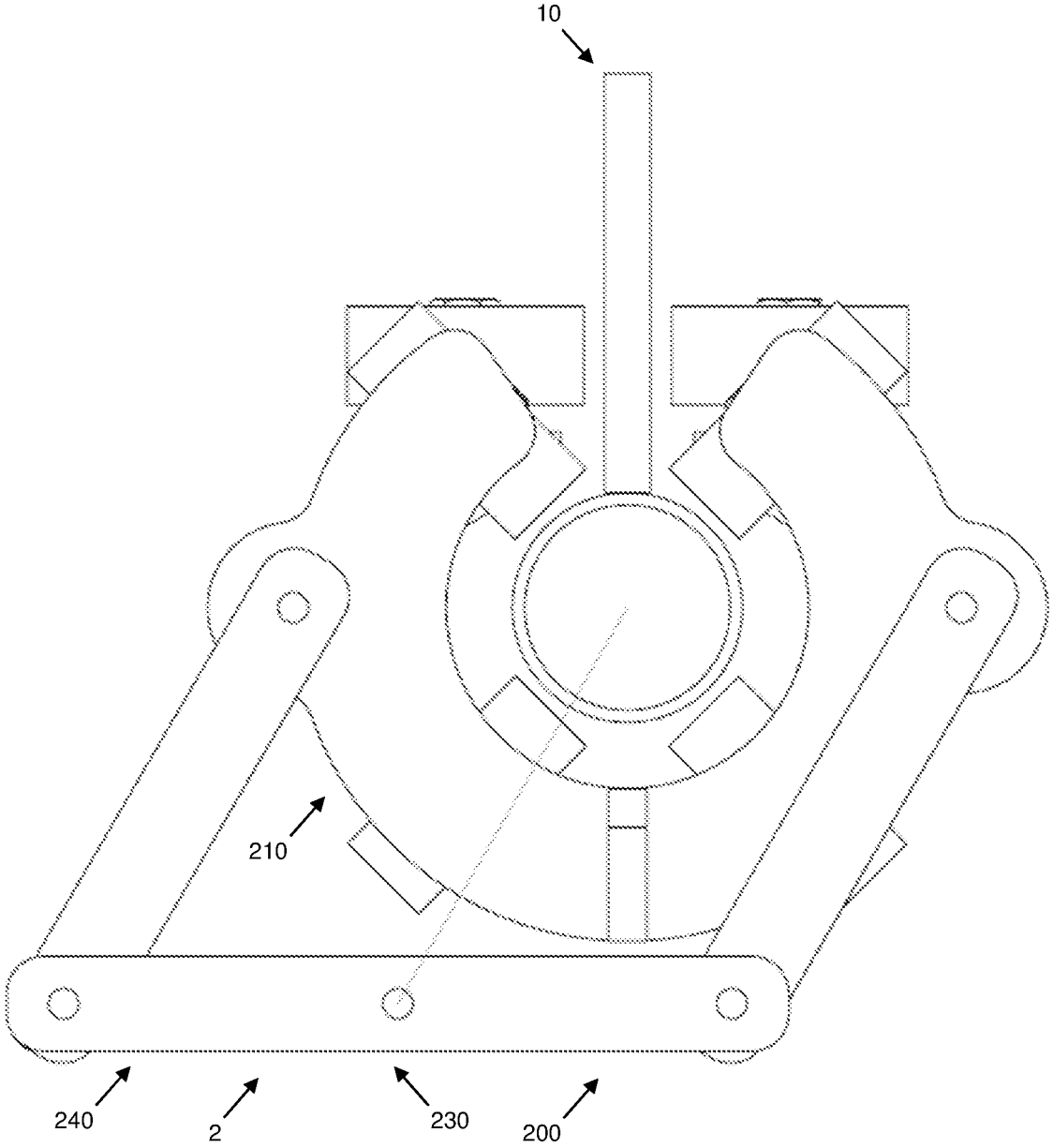
FIG. 13 schematically depicts an end view of a rail assembly according to an exemplary embodiment, including a trolley according to an exemplary embodiment.
Figure 14:
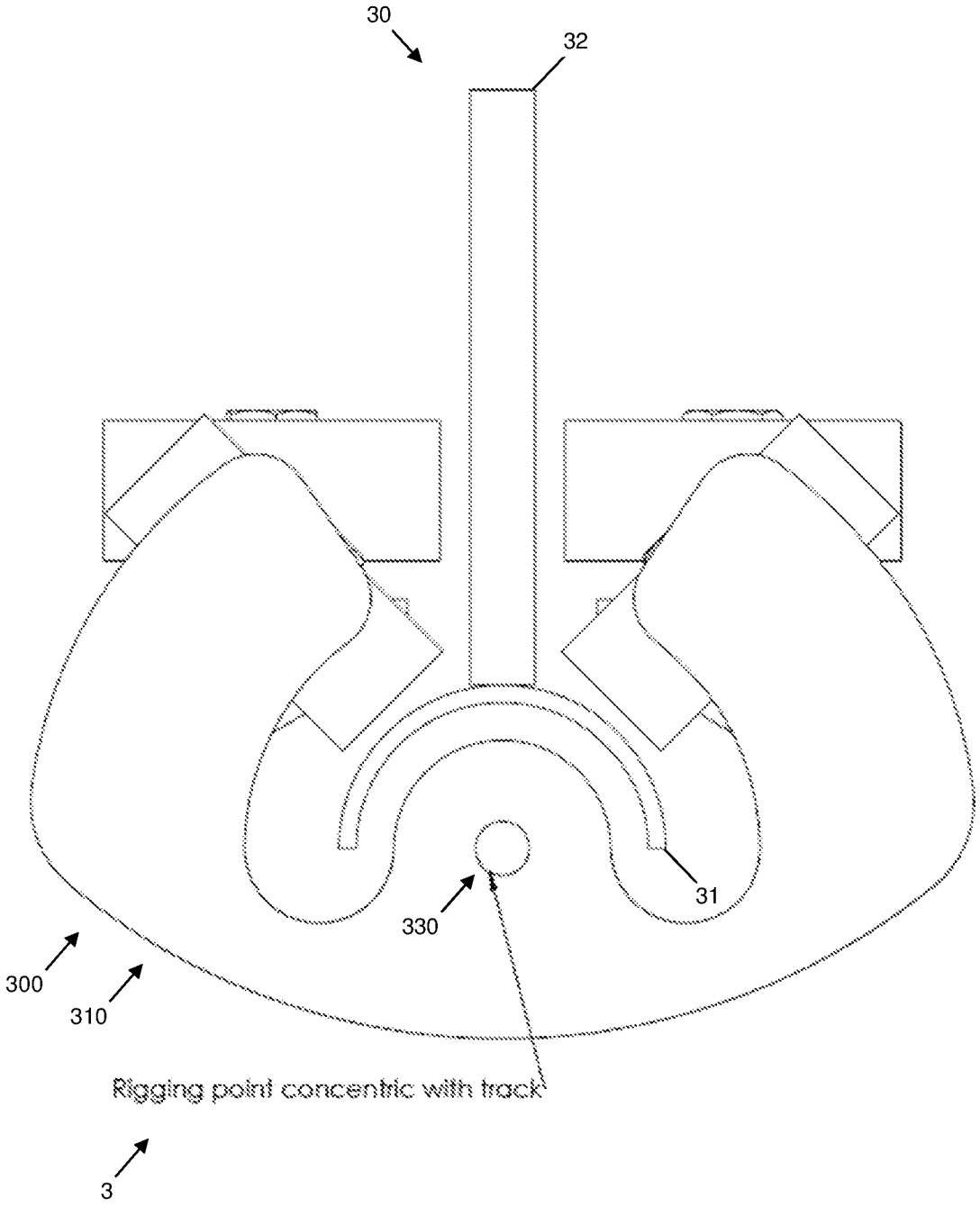
FIG. 14 schematically depicts an end view of a rail assembly according to an exemplary embodiment, including a trolley according to an exemplary embodiment.

Briefly, FIGS. 1 to 7 depict a rail assembly 1 according to an exemplary embodiment, including a trolley 100 according to an exemplary embodiment, arranged in a first configuration. FIGS. 8 to 10 show the trolley 100, in use, arranged in the first configuration and in a second configuration. FIGS. 11A to 110 and 12A to 10B depict details of the trolley 100. FIGS. 13 and 14 depict alternative rail assemblies according to exemplary embodiments, including trolleys according to exemplary embodiments. FIG. 1 schematically depicts a perspective view of the rail assembly 1 according to an exemplary embodiment, including the trolley 100 according to an exemplary embodiment. FIG. 2 schematically depicts an end view of the rail assembly 1 of FIG. 1. FIG. 3 schematically depicts a side view of the rail assembly 1 of FIG. 1. FIG. 4 schematically depicts a plan view of the rail assembly 1 of FIG. 1. FIG. 5 schematically depicts a plan view of the rail assembly of FIG. 1. FIG. 6 schematically depicts a longitudinal cross-sectional view of the rail assembly of FIG. 5, particularly in the plane B-B of FIG. 5. FIG. 7 schematically depicts a longitudinal cross-sectional view of the rail assembly of FIG. 5, in more detail, particularly of a region B of FIG. 5.

Particularly, the trolley 100 is for a rail 10. The trolley 100 comprises a frame 110, a set S of wheels 120, including a first wheel 120A and a second wheel 120B, rotatably coupled to the frame 110 and an attachment member 130, coupled to the frame 110, for suspension of a load W therefrom, in use. The first wheel 120A is rotatable in a first plane P1 about a first axis A1 and the second wheel 120B is rotatable in a second plane P2 about a second axis A2. The first plane P1 and the second plane P2 define a line L. The trolley 100 is arrangeable in a first configuration, wherein the attachment member 130 is arranged at a first angular displacement D1 about the line L. The trolley 100 is arrangeable in a second configuration, wherein the attachment member 130 is arranged at a second angular displacement D2 about the line L, wherein the first angular displacement D1 and the second angular displacement D2 are different.

Since the attachment member 130 is moveable between the first configuration and the second configuration, transverse forces on the rail 10 may be reduced compared with a fixed attachment member, for example, as described above. In this way, a likelihood of the trolley 100 binding and hence braking on the rail 10 is reduced. In this way, a likelihood of injury and/or stranding of users may be reduced. In this way, user safety and/or trolley reliability may be improved.

Furthermore, since the transverse forces on the rail 10 may be reduced compared with a fixed attachment member 130, for example, a number of wheels included in the set S of wheels 120 and/or a size of the wheels included in the set S of wheels 120 may be reduced. Additionally and/or alternatively, a strength of the frame 110 may be reduced. In this way, a weight and/or cost of the trolley 100 may be reduced. Conversely, an increased load W may be attached to the trolley 100.

Trolley

The trolley 100 is suitable for use with the rail 10 and is arranged to roll thereon. Generally, the trolley 100 is retained on the rail 10, for example by the set S of wheels 120, so that the trolley 100 may not be removed from (i.e. come off) the rail 10, in use.

The trolley 100 comprises the frame 110, to which the set S of wheels 120 are rotatably coupled and to which the attachment member 130 is coupled. That is, the frame 110 transfers forces due to the load W to at least one of the wheels of the set S of wheels 120, for example the first wheel 120A and/or the second wheel 120B. In this example, the frame 110 comprises an open structure, for example provided by one or more struts and/or one or more ties. In this example, the frame 110 is fabricated from welded aluminium plate (grade 5083), having a thickness of 5 mm. The frame includes two end C-shaped parts 110A, 1108, four bars 110C to 110F extending therebetween, a middle C-shaped part 110G therebetween, two brackets 110H, 110I coupled to the bars 110C and 100F and two secondary attachment members 110J, 110K coupled to the two end C-shaped parts 110, 110B, respectively. In this example, the frame 110 comprises a passageway P for the rail 10 to pass therethrough. The secondary attachment members 110J, 110K are for attachment of a handle and a secondary harness sling, respectively.

Set of Wheels

The trolley 100 comprises the set S of wheels 120, including the first wheel 120A and the second wheel 120B, rotatably coupled to the frame 110. In the Figures, the wheels of the set S of wheels 120 are generally shown not in contact with the rail 10, for clarity. However, it should be understood that, in use, one or more of the wheels of the set S of wheels 120 are generally in contact with the rail 10. For example, in use, one or more or all of the wheels of a subset S1 of wheels 120 (as described below), including the first wheel 120A and the second wheel 120B, are generally in contact with the rail 10. For example, in use, one or more or all of the wheels of a subset S2 and/or a subset S3 of wheels 120 (as described below) are generally not in contact with the rail 10, spaced apart therefrom by a gap of about 5 mm, but may contact the rail 10 during yawing, pitching and/or rolling of the trolley 100.

In this example, the first wheel 120A and the second wheel 120B are arranged to roll on an upper and/or lateral portion or portions of the rail 10, particularly of a tube 11 thereof, and thereby transfer, at least in part, a weight due to the load Won to the rail 10 and/or forces due to movement, for example pitching and/or yawing, of the load W on to the rail 10. In this example, the first wheel 120A and the second wheel 120B are arranged at a same end of the frame 110. In this example, the first wheel 120A and the second wheel 120B are arranged on opposed sides of the passageway P therein, whereby the first wheel 120A and the second wheel 120B are arranged, in use, on opposed sides of the rail 10.

In this example, the set S of wheels 120 includes a third wheel 120C and a fourth wheel 120D, as described with respect to the first wheel 120A and the second wheel 120B, respectively. In this example, the third wheel 120C and the fourth wheel 120D are arranged at opposed an end of the frame 110 to the first wheel 120A and the second wheel 120B, the first wheel 120A and the third wheel 120C are arranged on opposed sides of the passageway therein and the second wheel 120B and the fourth wheel 120D are arranged on opposed sides of the passageway therein.

In this example, the set S of wheels 120 is arranged to retain the trolley 100 on the rail 10, so that the trolley 100 may not be removed from (i.e. come off) the rail 10, in use. In other words, the trolley 100 is captive on the rail 10, thereby improving safety.

In this example, the set S of wheels 120 is arranged to resist, at least in part, forces in 2 mutually orthogonal directions, for example due to the weight of the load W and/or pitching, rolling and/or yawing of the trolley 100, while permitting movement of the trolley 100 in a third mutually orthogonal direction, for example along, down and/or up the rail 10.

Subsets of Wheels

In this example, the set S of wheels 120 includes the first subset S1 of wheels 120, including the first wheel 120A, the second wheel 120B and, the third wheel 120C and the fourth wheel 120D. In this example, the first subset S1 of wheels 120 are arranged to roll on an upper and/or lateral portion or portions of the rail 10, particularly the tube 11 thereof, and thereby transfer, at least in part, a weight due to the load W on to the rail 10 and/or forces due to movement, for example pitching and/or yawing, of the load W on to the rail 10. In this example, the first wheel 120A and the third wheel 120C are rotatably coupled to the first bar 110C of the frame 110. In this example, the second wheel 120B and the fourth wheel 120D are rotatably coupled to the second bar 110D of the frame 110.

In this example, the set S of wheels 120 includes the second subset S2 of wheels 120, including a fifth wheel 120E, a sixth wheel 120F, a seventh wheel 120G and an eighth wheel 120H. In this example, the second subset S2 of wheels 120 are arranged to roll on a lower and/or lateral portion or portions of the rail 10, particularly the tube 11 thereof, and thereby transfer, at least in part, forces due to movement, for example pitching and/or yawing, of the load Won to the rail 10. In this example, the fifth wheel 120E and the seventh wheel 120G are rotatably coupled to the third bar 110E of the frame 110. In this example, the sixth wheel 120F and the eighth wheel 120H are rotatably coupled to the fourth bar 110F of the frame 110.

In this example, the set S of wheels 120 includes the third subset S3 of wheels 120, including a ninth wheel 120I and a tenth wheel 120J. In this example, the third subset S3 of wheels 120 are arranged to roll on a lateral portion of the rail 10, particularly a flange 12 thereof, and thereby transfer, at least in part, forces due to movement, for example rolling, of the load W on to the rail 10. In this example, the ninth wheel 120I is rotatably coupled to the first bracket 110H and the tenth wheel 120J is rotatably coupled to the second bracket 110I.

Wheel Orientation

The first wheel 120A is rotatable in the first plane P1 about the first axis A1 and the second wheel 120B is rotatable in the second plane P2 about the second axis A2, wherein the first plane P1 and the second plane P2 define the line L.

In this example, the first axis A1 and the second axis A2 are mutually inclined, whereby the first plane P1 and the second plane P2 are mutually inclined. If the first plane P1 and the second plane P2 are mutually inclined, the line L is defined by the intersection of the first plane P1 and the second plane P2. In this example, the line L is the intersection of the first plane P1 and the second plane P2. In this example, the line L is the intersection of the first plane P1 and the second plane P2 and the rail 10 comprises a cylindrical running surface defining a cylinder axis, wherein the line L is substantially coincident, in use, with the cylinder axis.

In this example, the first axis A1 and the second axis A2 are tangential to a radius normal to the line L.

Wheel

In this example, the first wheel 120A comprises a polyurethane roller, having an outside diameter of 62 mm, bonded to a deep-groove ball bearing, for example a SKF 6301 ZZ deep-groove ball bearing having a 12 mm bore and a 12 mm length.

In this example, the first wheel 120A is mounted on an axle, wherein the axle is fastened to the frame 110. In this example, the axle is a bolt, fastened to the frame 110 using a nut.

In this example, the first wheel 120A is a passive wheel (i.e. not driven).

The second wheel 120B is as described with respect to the first wheel 120A. Each wheel of the subset S of wheels 120 is as described with respect to the first wheel 120A.

Attachment Member

The trolley 100 comprises the attachment member 130, coupled to the frame 110, for suspension, of the load W therefrom, in use.

In this example, the attachment member 130 is releasably coupled to the frame 110. In this example, release of the attachment member 130 from the frame 110 requires a use of a tool. In this example, the attachment member 130 comprises a fastener, for example a pin fastener, a split pin (also known as a cotter pin, cotter key or a split cotter), a locking ring, a mouse, or a clamp to restrict release of the attachment member 130 from the frame 110. In this way, inadvertent or deliberate release of the attachment member 130, in use, may be avoided, thereby improving safety. In this example, the attachment member 130 comprises a D-shackle, closed with an anchor bolt.

Guide

The frame 100 comprises a guide 112, as described below with reference to FIGS. 11A to 11C.

Roller

In this example, the attachment member 130 comprises a roller 132 arranged to roll on the guide 112. A related attachment member 130' is described below, with reference to FIGS. 12A to 12B.

In this example, the roller 132 is a grooved roller 132, having a circumferential radiused groove, and the guide 112 has a circular-cross section. In this example, the radius of the groove is larger than the radius of the guide 112, for example in a range of 1% to 20%, preferably in a range from 3% to 10%.

In this example, the attachment member 130 comprises a D shackle 133, closed with an anchor bolt 134, and a grooved roller 132, having a circumferential radiused groove, wherein the attachment member 130 comprises two ball bearings 135A, 135B, wherein the grooved roller 132 is mounted on the anchor bolt 134 between the legs of the D shackle 133, spaced apart therefrom by two spacers 136A, 136B.

In this example, the attachment member 130 is rotatable about a normal to the line L. In this way, twisting of the load W relative to the trolley 100 may be accommodated.

In this example, the roller 132 is formed from stainless steel SAE Type 316.

First Configuration and Second Configuration

FIG. 8 schematically depicts a side view of the rail assembly 1 of FIG. 1. FIG. 9 schematically depicts a transverse cross-sectional view of the rail assembly 1 of FIG. 8, in the first configuration and in the second configuration, particularly in the plane A-A of FIG. 8. FIG. 10 schematically depicts a transverse cross-sectional view of the rail assembly 1 of FIG. 8, in the first configuration and in the second configuration, in more detail, particularly region A of FIG. 9. Particularly, FIG. 9 and FIG. 10 show the attachment member 130 arranged at the first angular displacement D1 about the line L and the attachment member 130 arranged at the second angular displacement D2 about the line L. That is, the same attachment member 130 is shown at two different angular displacements, D1 and D2. It should be understood that a magnitude and/or direction of the load W at the two different angular displacements, D1 and D2, will be different.

In this example, a height or elevation of the attachment member 130 at the second angular displacement D2 is greater than that at the first angular displacement D1. That is, a second gravitational potential energy of the load W when the trolley 100 is arranged in the second configuration is greater than a first gravitational potential energy of the load W when the trolley 100 is arranged in the first configuration. That is, work must be done to move the attachment member 130 from the first configuration to the second configuration. In this way, movement of the load W and hence the attachment member 130 transverse to the line L may be controlled, for example moderated.

In this example, the trolley 100 is arranged to move from the first configuration to the second configuration due to a force transverse to the line L (i.e. a lateral force, a transverse force) due, at least in part, movement of the load W transverse to the line L.

In this example, the attachment member 130 is arranged to move from the first angular displacement D1 to the second angular displacement D2 in an arc, for example of increasing height or elevation, about the line L. In this example, the rail 10 comprises a cylindrical running surface defining a cylinder axis, wherein the line L is substantially coincident, in use, with the cylinder axis, wherein the attachment member 130 is arranged to move from the first angular displacement D1 to the second angular displacement D2 in an arc about the line L and wherein the arc is concentric with the cylindrical running surface.

Guide

FIGS. 11A to 11C schematically depict a perspective view, an end view and a side view, respectively, of the guide 112 of the trolley 100 of FIG. 1, in more detail.

In this example, the trolley 100 comprises the guide 112 coupled to the frame 110, arranged to guide 112 the attachment member 130 between the first configuration and the second configuration. In this example, the guide 112 comprises an arcuate portion, subtending an angle of about 100°. In this example, the guide 112 has a circular cross-section, whereby the guide 112 comprises a round bar, having a diameter of 12 mm. In this example, the guide 112 is formed from stainless steel SAE Type 316. Brackets are provided at each end of the round bar, the brackets including countersunk 8 mm diameter holes for fastening the guide 112 to the bars 110E and 110F using countersunk (allen key) bolts and nuts.

Roller

Figure 12A:
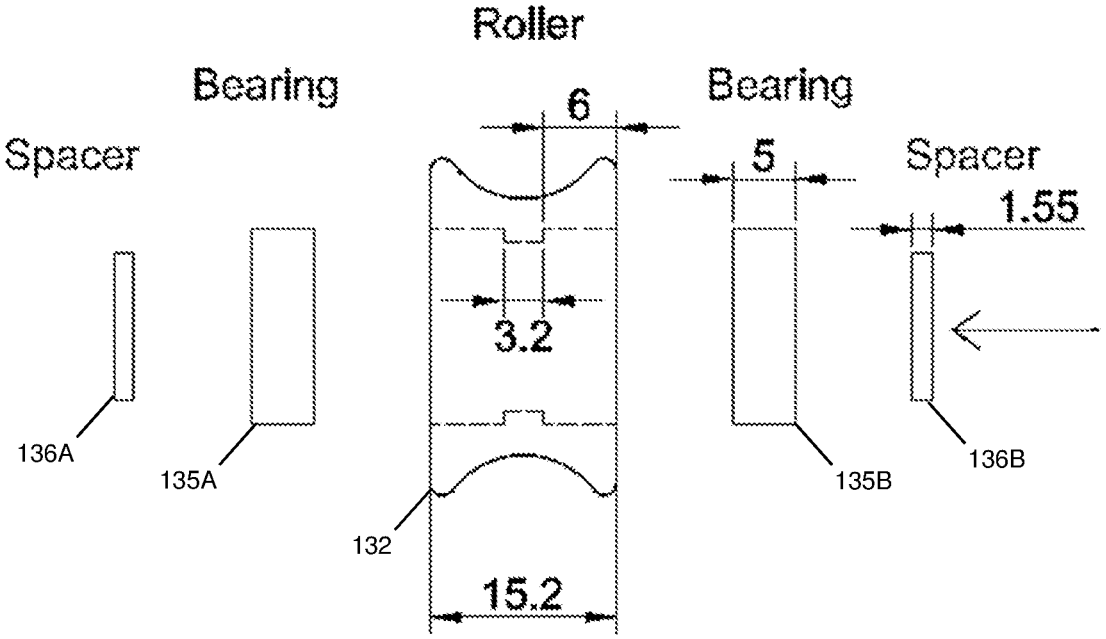
FIG. 12A to 12B schematically depict a partial exploded view and a partially transparent end view, respectively, of an attachment member for the trolley of FIG. 1, in more detail.
Figure 12B:
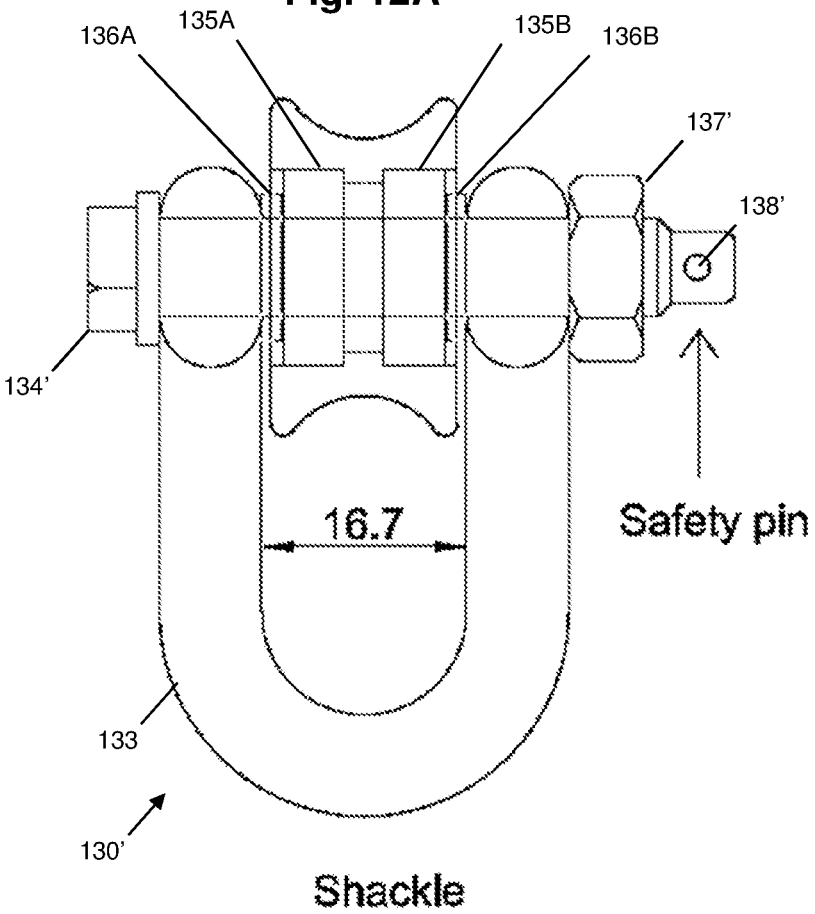

FIGS. 12A to 12B schematically depict a partial exploded view and a partially transparent end view, respectively, of an attachment member 130' for the trolley of FIG. 1, in more detail. The attachment member 130' is generally as described with respect to the attachment member 130. The attachment member 130 comprises the D shackle 133, closed with the anchor bolt 134. In contrast, the attachment member 130' comprises a pin shackle 133', closed with an anchor bolt 134' and a split pin 138' and including a securing nut 137' in addition to the split pin 138'.

In this example, the attachment member 130' comprises the roller 132 arranged to roll on the guide 112. In this example, the roller 132 comprises two bearings deep-groove ball bearings 135A, 135B. In this example, the bearings 135A, 135B are sealed. In this example, the attachment member 130' comprises two spacers 136A, 136B.

In this example, the roller 132 is a grooved roller 132, having a circumferential radiused groove, and the guide 112 has a circular-cross section. In this example, the radius of the groove is larger than the radius of the guide 112, in a range of 1% to 20%.

In this example, the attachment member 130' comprises a pin shackle 133', closed with an anchor bolt 134' and a split pin 138' and including a securing nut 137' in addition to the split pin 138', and a grooved roller 132, having a circumferential radiused groove, wherein the grooved roller 132 comprises the two ball bearings 135A, 135B, wherein the grooved roller 132 is mounted on the anchor bolt 134' between the legs of the shackle 133', spaced apart therefrom by the two spacers 136A, 136B.

Rail Assembly

The rail assembly 10 includes the rail 10 and the trolley 100.

In this example, the rail 10 is a monorail 10 (i.e. a single rail 10).

In this example, the rail 10 comprises a cylindrical running surface defining a cylinder axis, wherein the line L is substantially coincident, in use, with the cylinder axis, for example provided by a tube 11 having a circular cross-section and the rail 10 comprises a longitudinal flange 12 normal to the tube 11 (i.e. upstanding therefrom) extending continuously along the tube 11. In this example, the tube 11 has an outside diameter of 60 mm and a wall thickness of 3 mm. In this example, the flange 12 is welded to the tube 11, for example continuously or intermittently.

In this example, the rail 10 is formed from steel according to EN 10025: part 2: 2004 grade S235. In this example, the rail 10 is painted.

Although a preferred embodiment has been shown and described, it will be appreciated by those skilled in the art that various changes and modifications might be made without departing from the scope of the invention, as defined in the appended claims and as described above.

FIG. 13 schematically depicts an end view of a rail assembly 2 according to an exemplary embodiment, including a trolley 200 according to an exemplary embodiment.

The rail assembly 2 and the trolley 200 are generally as described with respect to the rail assembly 1 and the trolley 100, respectively. Like reference signs indicate like features, description of which is not repeated for brevity. The rail 10 is as described previously. In contrast to the trolley 100, the trolley 200 comprises a mechanical linkage 240, coupled to the frame 210, and the attachment member 230 is coupled to the mechanical linkage 240. In this example, the mechanical linkage 240 comprises a planar quadrilateral linkage.

FIG. 14 schematically depicts an end view of a rail assembly 3 according to an exemplary embodiment, including a trolley 300 according to an exemplary embodiment.

The rail assembly 3, the rail 30 and the trolley 300 are generally as described with respect to the rail assembly 1, the rail 10 and the trolley 100, respectively. Like reference signs indicate like features, description of which is not repeated for brevity. In this example, the rail comprises a U shape channel 31 and a flange 32. In contrast to the trolley 100, the trolley 300 does not include a second subset of wheels and the frame 310 is modified accordingly. In contrast to the trolley 100, the trolley 300 comprises an attachment member 330 rotatably coupled to frame 310. In this example, the attachment member 330 is arranged to rotate about the line L whereby, in the first configuration, the attachment member 330 is arranged at a first angular rotation about the line L and whereby in the second configuration, the attachment member 330 is arranged at a second angular rotation about the line L, wherein the first angular rotation and the second angular rotation are different.

In summary, a trolley, a rail assembly and a kit of parts for a rail assembly are described. The trolley comprises an attachment member moveable between a first configuration and a second configuration, whereby transverse forces on the rail may be reduced compared with a fixed attachment member, for example. In this way, a likelihood of the trolley binding and hence braking on the rail is reduced. In this way, a likelihood of injury and/or stranding of users may be reduced. In this way, user safety and/or trolley reliability may be improved. In addition, a smoothness and a quality of the ride may be improved.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims and drawings), and/or all of the steps of any method or process so disclosed, may be combined in any combination, except combinations where at least some of such features and/or steps are mutually exclusive.

Each feature disclosed in this specification (including any accompanying claims, and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims and drawings), or to any novel one, or any novel combination, of the steps of any method or process so disclosed.

The invention claimed is:

1. A trolley for a rail, the trolley comprising:

a frame;

a set of wheels, including a first wheel and a second wheel, rotatably coupled to the frame; and an attachment member, coupled to the frame, for attachment of a load therefrom, in use;

a guide coupled to the frame, arranged to guide the attachment member between a first configuration and a second configuration, wherein the attachment member comprises a roller arranged to roll on the guide, wherein the first wheel is rotatable in a first plane about a first axis and the second wheel is rotatable in a second plane about a second axis, wherein the first plane and the second plane define a line, wherein the trolley is arrangeable in:

the first configuration, wherein the attachment member is arranged at a first angular displacement about the line; and the second configuration, wherein the attachment member is arranged at a second angular displacement about the line, wherein the first angular displacement and the second angular displacement are different.

2. The trolley according to claim 1, wherein the line is the intersection of the first plane and the second plane.

3. The trolley according to claim 1, wherein the attachment member is arranged to move from the first angular displacement to the second angular displacement in an arc about the line.

4. The trolley according to claim 1, wherein the roller is a grooved roller and/or wherein the guide has a circular-cross section.

5. The trolley according to claim 1, wherein the attachment member is rotatable about a normal to the line.

6. The trolley according to claim 1, wherein the first wheel and the second wheel are plain wheels.

7. The trolley according to claim 1, wherein the first axis and/or the second axis is tangential to a radius normal to the line.

8. The trolley according to claim 1, wherein the set of wheels includes 3 or more wheels.

9. A rail assembly including a rail and the trolley according to claim 1.

10. The rail assembly according to claim 9, wherein the rail comprises a non-linear portion.

11. The rail assembly of claim 10, wherein the non-linear portion is curved.

12. The rail assembly according to claim 9, wherein the rail is a monorail.

13. The rail assembly according to claim 9, wherein the rail comprises a cylindrical running surface defining a cylinder axis, wherein the line is substantially coincident, in use, with the cylinder axis.

14. The rail assembly according to claim 9, wherein the rail comprises a longitudinal flange.

15. The trolley according to claim 1, wherein the attachment member is adapted to suspend the load therefrom.

* * * * *